United States Patent [19]

Hoffend et al.

[11] Patent Number: 4,490,455

[45] Date of Patent: Dec. 25, 1984

[54] AMINE ACID SALT CHARGE ENHANCING TONER ADDITIVES

[75] Inventors: Thomas R. Hoffend, Webster; Michelle M. Bruzee, Rochester, both of N.Y.

[73] Assignee: Xerox Corporation, Stamford, Conn.

[21] Appl. No.: 451,135

[22] Filed: Dec. 20, 1982

[51] Int. Cl.[3] ..... G03G 9/08; G03G 9/10

[52] U.S. Cl. ..... 430/110

[58] Field of Search ..... 430/110

[56] References Cited

U.S. PATENT DOCUMENTS

| | | | |
|---|---|---|---|
| 4,221,856 | 9/1980 | Lu | 430/110 |
| 4,224,396 | 9/1980 | Pollet | 430/107 |
| 4,254,205 | 3/1981 | Lu et al. | 430/122 |
| 4,256,824 | 3/1981 | Lu | 430/122 |
| 4,264,697 | 4/1981 | Perez et al. | 430/107 |
| 4,264,702 | 4/1981 | Lu et al. | 430/108 |
| 4,269,922 | 5/1981 | Lu et al. | 430/126 |
| 4,286,037 | 8/1981 | Hectors et al. | 430/107 |
| 4,291,112 | 9/1981 | Lu | 430/110 |
| 4,298,672 | 11/1981 | Lu | 430/108 |
| 4,338,390 | 7/1982 | Lu | 430/106 |

OTHER PUBLICATIONS

Jadwin et al., "Electrographic Toner & Developer Composition", Res. Discl. 14017, Dec. 1975, pp. 6–7.

*Primary Examiner*—Roland E. Martin

*Attorney, Agent, or Firm*—E. O. Palazzo

[57] ABSTRACT

This invention is generally directed to an electrostatic toner composition comprised of resin particles, pigment particles, and from about 0.25 weight percent to about 20 weight percent based on the weight of the toner particles of an amine acid salt charge enhancing additive composition of the following formula:

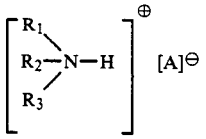

wherein $R_1$, $R_2$ and $R_3$ are independently selected from the group consisting of alkyl groups, and aromatic groups, and A is an anion.

24 Claims, No Drawings

AMINE ACID SALT CHARGE ENHANCING TONER ADDITIVES

BACKGROUND OF THE INVENTION

This invention is generally directed to toner compositions, and developer compositions, and more specifically, the present invention is directed to toner compositions containing certain charge enhancing additives. The compositions of the present invention are useful in electrostatographic imaging systems, particularly those systems incorporating a Viton fuser roll.

Electrostatographic process, and more specifically the xerographic process is well known as documented in several prior art references. This process involves the development of an electrostatic latent image by applying toner particles to the image to be developed using, for example, cascade development, magnetic brush development, touchdown development, and the like. The toner particles applied can be charged negatively or positively, depending upon the charge deposited on the photoreceptor surface. Thus, for example, if it is desired to develop a negatively charged imaging surface, the toner particles are positively charged usually by incorporating therein certain charge enhancing additives.

Numerous types of charge enhancing additives are known in the prior art, including those which impart a positive charge to the toner composition. For example, there is disclosed in U.S. Pat. No. 3,893,935 the use of certain quaternary ammonium compounds as charge control agents for electrostatic toner compositions. According to the disclosure of this patent, certain quaternary ammonium compounds when incorporated into toner materials were found to provide a toner composition which exhibited relatively high uniform and stable net toner charge when mixed with a suitable carrier particle. A similar teaching is contained in U.S. Pat. No. 4,079,014 with the exception that a different charge control agent is used, namely, a diazo type material. Additionally, there is described in U.S. Pat. No. 4,298,672 toner compositions containing as positive charge enhancing additives alkyl pyridinium materials, including cetyl pyridinium chloride.

Additionally, there is disclosed in U.S. Pat. No. 4,338,390, charge control additives compatible with Viton fuser systems, which additives are comprised of organic sulfate or sulfonate materials, including stearyl dimethyl phenethyl ammonium para-toluene sulfonate, and the like.

While the charge enhancing additives described in the prior art are suitable for their intended purposes, that is for imparting a positive charge for example, to the toner resin, many of these additives interact with certain fuser rolls incorporated into the electrostatographic imaging system. For example, it is known that certain prior art charge enhancing additives adversely affect Viton fuser rolls, causing a deterioration in the quality of images developed in electrostatographic copying systems containing such rolls. Thus, for example, Viton fuser rolls discolor and turn black, as well as develop multiple surface cracks when developer compositions containing many of the prior art charge control additive compounds contact the Viton fuser roll.

An example of one type of Viton fuser roll used in electrographic copying machines, particularly xerographic copying machines, is comprised of a soft roll fabricated from lead oxide and duPont Viton E-430 resin (a vinylidene fluoride, hexafluoropropylene copolymer). Approximately 15 parts of lead oxide and 100 parts of the Viton E-430 are blended together and cured on a roll at elevated temperatures. Apparently the function of the lead oxide is to generate unsaturation by dehydrofluorination for crosslinking, and to provide release mechanisms for the toner. Excellent image quality has been obtained with the use of Viton fuser rolls, however, in some instances there is a toner fuser compatibility problem when charge control agents are contained in the toner mixture. For example, it is believed that certain quaternary ammonium charge control additives, and alkyl pyridinium compounds react with the Viton fuser roll. Thus, an alkyl pyridinium chloride, such as cetyl pyridinium chloride when part of the toner mixture appears to attack the fuser roll, resulting in a highly unsaturated compound which polymerizes and condenses with the unsaturated Viton. As a result the Viton fuser turns black, and develops multiple surface cracks, thereby resulting in image quality deterioration.

There thus continues to be a need for improved charge enhancing additives for incorporation into toner compositions, and developer compositions. Additionally, there continues to be a need for charge enhancing additives which impart a positive charge to the toner resin particles. Also, there is a need for toner compositions and developer compositions which contain charge enhancing additives that do not adversely affect fuser rolls, and in particular, Viton fuser rolls selected for use in electrostatographic imaging systems. Additionally, there is a need for charge enhancing additives which can be prepared by a simple, direct, economical process, thereby decreasing the cost of the toner compositions involved. Furthermore, there continues to be a need for toner compositions which will rapidly charge new uncharged toner particles which are added to a positively charged toner of the same composition.

SUMMARY OF THE INVENTION

It is an object of the present invention to provide a toner composition which overcomes the above-noted disadvantages.

It is a further object of the present invention to provide developer compositions which contain toner particles and carrier particles, wherein the toner particles are charged positively.

It is a yet another object of the present invention to provide toner particles for use in developer compositions, which particles have improved humidity sensitivity, while simultaneously being compatible with Viton fuser rolls.

It is yet an additional object of the present invention to provide toner compositions which will develop electrostatic images containing negative charges on a photoreceptor surface.

In still another object of the present invention, there are provided toner compositions which will transfer effectively electrostatically from a negatively charged photoreceptor surface, containing an image thereon, to plain bond paper without causing blurring or effecting adversely the quality of the resulting images, particularly when such toner compositions are used as part of a developer composition, incorporated in a xerographic copying system containing a Viton fuser roll.

It is a further object of the present invention to provide amine acid salt charge enhancing additives for incorporation into toner compositions.

These and other objects of the present invention are accomplished by providing electrostatic toner compositions comprised of resin particles, pigment particles, and a charge enhancing amine acid salt composition of the following formula:

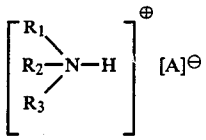

wherein $R_1$, $R_2$ and $R_3$ are independently selected from the group consisting of alkyl groups and aromatic groups, and A is an anion. In a preferred embodiment of the present invention, $R_1$ and $R_2$ are methyl, $R_3$ is stearyl ($C_{18}H_{37}$), and A is a tosylate anion.

Illustrative examples of alkyl groups for $R_1$, $R_2$ and $R_3$ include those containing from about 1 to about 25 carbon atoms such as methyl, ethyl, propyl, butyl, pentyl, hexyl, octyl, nonyl, decyl, myristyl, cetyl, oleyl, pentadecyl, heptadecyl, stearyl, cyclohexyl, cosyl, and the like. Preferred alkyl groups for $R_1$ and $R_2$ include methyl, ethyl, propyl, butyl and pentyl, while preferred alkyl groups for $R_3$ include those containing from about 8 carbon atoms to about 25 carbon atoms such as cetyl, and stearyl.

Examples of aromatic groups for $R_1$, $R_2$ and $R_3$ include those containing from about 6 to about 24 carbon atoms such as phenyl, napthyl, tolyl, benzyl, phenethyl, anthryl, and the like, with phenyl being preferred.

Illustrative examples of the anion A include those anions derived from aromatic substituted sulfonic acids such as benzene sulfonic acid, para-methoxy benzene sulfonic acid, para-methyl benzene sulfonic acid, (tosylate), para-chloro benzene sulfonic acid, parabromo benzene sulfonic acid, para-nitro benzene sulfonic acid, the corresponding ortho derivatives, and the like.

Illustrative specific examples of amine acid salt charge enhancing additives included within the scope of the present invention and embraced by the above identified formula include those prepared from the reaction of the following tertiary amines with the following aromatic sulfonic acids.

Examples of tertiary amines selected include N,N-dimethyl-n-octyl amine; N,N-dimethyl-n-decyl amine; N,N-dimethyl-n-dodecyl amine; N,N-dimethyl tetradecyl amine; N,N-dimethyl hexadecyl amine; N,N-dimethyl octadecyl amine; N,N-dimethyl cosyl amine; N,N-dimethyl docosyl amine; N,N-dimethyl tetracosyl amine; N,N-distearylmethyl amine; N,N-dibehenyl methyl amine; N,N-dioctyl methyl amine; N,N-diethyl cyclohexyl amine; N,N-dimethyl aniline; N,N-diethyl aniline; N,N-dimethyl-p-toluidine; N,N-dimethyl-1-napthyl amine; N,N-dimethyl phenethyl amine, and the like.

Examples of aromatic sulfonic acids include benzene sulfonic acid, para-methoxy benzene sulfonic acid, para-methyl benzene sulfonic acid, para-chloro benzene sulfonic acid, para-bromo benzene sulfonic acid, para-nitro benzene sulfonic acid, the corresponding ortho derivatives, and the like. The preferred sulfonic acid is para-methyl benzene sulfonic acid.

Specific examples of amine acid salt charge enhancing additives included within the scope of the present invention are stearyl dimethyl amine tosylate, lauryl(-dodecyl)dimethyl amine tosylate, octyl dimethyl amine tosylate, distearyl methyl amine tosylate, and the like.

The preferred amine acid salt charge enhancing additive of the present invention is stearyl dimethyl amine tosylate of the following formula:

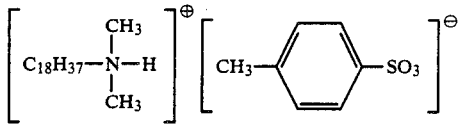

The amine salt charge enhancing additives of the present invention can be prepared by a number of processes, including known processes, wherein an appropriate aromatic sulfonic acid is reacted with a tertiary amine. In one process of preparation, a benzene sulfonic acid, such as p-(para)-methylbenzene sulfonic acid, is reacted with a tertiary amine, such as N,N-dimethyl-n-octyl amine, in the presence of an aliphatic alcohol, at a temperature of from about 25° C. to about 80° C., and preferably at a temperature of from about 50° C. to about 60° C. Subsequently, the reaction mixture is allowed to cool to room temperature wherein a white crystalline precipitate forms. The precipitate is then separated from the reaction mixture by filtration, and the desired product, which is identified by elemental analysis, is recovered.

The amine acid salt charge enhancing additives that result from the process described herein were identified by a number of know means, including elemental analysis, infra-red spectroscopy, nuclear magnetic resonance (NMR), and the like.

In one illustrative typical reaction sequence, stearyl dimethyl amine is reacted with para-toluene sulfonic acid monohydrate, resulting in stearyl dimethyl amine tosylate, identified by elemental analysis, the reaction being represented by the following equations:

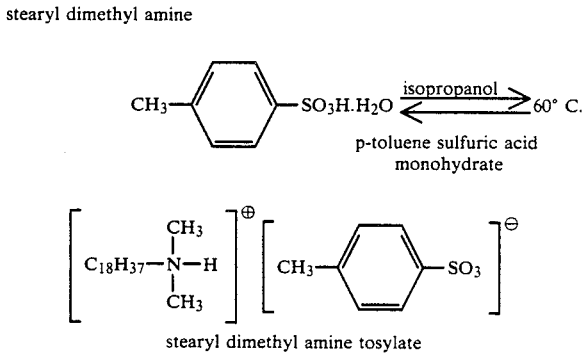

The amine acid salt charge enhancing additives of the present invention are incorporated into toner compositions in various amounts, providing the objectives of the present invention are achieved. Thus, for example, these additives are present in the toner composition in amounts that cause the toner particles to become positively charged in comparison to the carrier particles. The amount of amine acid salt incorporated into the toner composition can range for example, from about 0.25 weight percent to about 20 weight percent, and preferably from about 0.5 weight percent to about 4.0 weight percent. Moreover, the amine acid salt charge enhancing additives of the present invention can be blended into the developer composition, (toner plus carrier particles) or coated on the pigment particles, such as carbon black.

Numerous known methods may be employed to produce the toner compositions of the present invention, including melt mixing of the polymer resin particles, pigment particles and the amine salt of the present invention, melt blending the resin particles and the pigment particles coated with the amine acid salts of the present invention followed by mechanical attrition, and the like.

While various suitable resins may be selected for the toner compositions of the present invention, illustrative examples of typical resins include polyamides, epoxies, polyurethanes, vinyl resins, polycarbonates, polyesters, and the like. Any suitable vinyl resin may be selected for the toners of the present system, including homopolymers or copolymers of two or more vinyl monomers. Typical of such vinyl monomeric units include: styrene, vinyl naphthalene, ethylenically unsaturated mono-olefins such as ethylene, propylene, butylene, isobutylene and the like; vinyl esters such as vinyl acetate, vinyl propionate, vinyl benzoate, vinyl butyrate and the like; ethylenically unsaturated diolefins, such as butadiene; isoprene and the like, esters of aliphatic monocarboxylic acids such as methyl acrylate, ethyl acrylate, n-butylacrylate, isobutyl acrylate, dodecyl acrylate, n-octyl acrylate, phenyl acrylate, methyl methacrylate, ethyl methacrylate, butyl methacrylate and the like; acrylonitrile, methacrylonitrile; vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; and mixtures thereof. Also, there may be selected as toner resins various vinyl resins blended with one or more other resins, preferably other vinyl resins, which insure good triboelectric properties and uniform resistance against physical degradation. However, nonvinyl type thermoplastic resins may also be employed including resin modified phenolformaldehyde resins, oil modified epoxy resins, polyurethane resins, cellulosic resins, polyether resins, polyester resins, and mixtures thereof.

Generally toner resins containing a relatively high percentage of styrene are preferred. The styrene resin may be a homopolymer of styrene or copolymers of styrene with other monomeric groups. Any of the above suitable typical monomeric units may be copolymerized with styrene by addition polymerization. Styrene resins may also be formed by the polymerization of mixtures of two or more unsaturated monomeric materials with styrene monomer. The addition polymerization technique embraces known polymerization techniques such as free radical, anionic, and cationic polymerization processes.

Additionally, esterification products of a dicarboxylic acid, and a diol comprising a diphenol may be used as a preferred resin material for the toner compositions of the present invention. These materials are illustrated in U.S. Pat. No. 3,655,374, the disclosure of which is totally incorporated herein by reference, the diphenol reactant being of the formula as shown in Column 4, beginning at line 5 of this patent, and the dicarboxylic acid being of the formula as shown in Column 6. Other preferred polyester materials selected for the polymer toner resin of the present invention include those described in U.S. Pat. No. 4,049,447, and Canadian Pat. No. 1,032,804, the disclosure of each of these patents being totally incorporated herein by reference.

The preferred resin for the toner compositions of the present invention is comprised of a styrene butadiene copolymer.

The resin is present in the toner composition in an amount providing a total sum of all toner ingredients equal to about 100 percent, thus, when about 10 percent by weight of the amine-acid salt of the present invention is present in the toner composition, and 10 percent by weight of colorant or pigment is present, such as carbon black, about 80 percent by weight of the resin particles are included in the toner composition.

Any suitable pigment or dye may be selected as the colorant for the toner particles, such materials being well known and including for example, carbon black, magnetites, including Mapico black, a mixture of iron oxides, iron oxides, nigrosine dye, chrome yellow, ultramarine blue, duPont oil red, methylene blue chloride, phthalocyanine blue and mixtures thereof. The pigment or dye should be present in the toner in sufficient quantity to render it highly colored, so that it will form a clearly visible image on the recording member. For example, where conventional xerographic copies of documents are desired, the toner may comprise a black pigment, such as carbon black, or a black dye such as Amaplast black dye available from the National Aniline Products, Inc. Preferably, the pigment is selected in amounts of from about 3 percent to about 50 percent by weight based on the total weight of toner, however, if the pigment employed is a dye, substantially smaller quantities, for example, less than 10 percent by weight, may be used.

Included within the scope of the present invention are magnetic toners wherein there is selected as one of the pigments a magnetic pigment such as Mapico black. Accordingly, there can be present in the toner composition as the pigment, from about 1 percent by weight to about 6 percent by weight of a colorant, such as carbon black, and from about 10 percent by weight to about 40 percent by weight, and preferably from about 15 percent by weight to about 30 percent by weight of a magnetite, such as Mapico black. Furthermore, the magnetic toner can contain as the exclusive pigment a magnetite, such as Mapico black. In this illustrative embodiment, the magnetite is present in an amount of from about 20 percent by weight to about 70 percent by weight. In one specific illustrative embodiment of the present invention, the magnetic toner composition contains 71 percent by weight of a styrene butadiene copolymer, (91 percent by weight of styrene and 9 percent by weight of butadiene), commercially available as Pliolite, 25 percent by weight of the magnetite Mapico black, 2 percent by weight of Regal 330 carbon black, and 2 percent by weight of stearyl dimethyl amine tosylate.

Various suitable carrier materials are selected for formulating the developer compositions of the present invention, (toner plus carrier) providing that these carrier particles are capable of triboelectrically obtaining a charge of opposite polarity to that of the toner particles. In the present invention in one embodiment that would be a negative polarity, so that the toner particles will adhere to and surround the carrier particles. Thus, the carriers are selected so that the toner particles acquire a charge of a positive polarity, and include materials such as glass, steel, nickel, iron ferrites, silicon dioxide and the like, with metallic carriers especially magnetic carriers being preferred. The carriers can be used with or without a coating. The coatings generally contain resins which charge negatively, such as polystyrene; homopolymers, copolymers, and terpolymers of halogen containing ethylenes including vinyl fluorides, vinylidene fluorides, vinyl chlorides, vinylidene chlorides, chlorotrifluoroethylene, and the like, illustrative examples of which include a vinyl chloride/chlorotrifluoroethylene copolymer, a vinyl chloride/vinyl acetate copolymer, a chlorotrifluoroethylene polymer, and various known vinyl chloride terpolymers. Many of the typical carriers that can be used are described in U.S. Pat. Nos. 2,618,441; 2,638,522; 3,533,835; and 3,526,533. Also nickel berry carriers as described in U.S. Pat. Nos. 3,847,604 and 3,767,598 can be employed, these carriers being nodular carrier beads of nickel characterized by surfaces of reoccurring recesses and protrusions providing particles with a relatively large external area. The diameter of the coated carrier particle is from about 25 to about 1,000 microns, thus allowing the carrier to possess sufficient density and inertia to avoid adherence to the electrostatic images during the development process.

The carrier may be mixed with the toner composition in any suitable combination, however, best results are obtained when about 1 to about 10 parts of toner are selected to about 100 parts by weight of carrier.

The toner and developer compositions of the present invention may be used to develop electrostatic latent images on most suitable electrostatic surfaces capable of retaining charge, including conventional photoconductors, however, the toners of the present invention are best utilized in systems wherein a negative charge resides on the photoreceptor, and this usually occurs with organic photoreceptors. Illustrative examples of such photoreceptors are dimethylaminobenzylidene; 4-dimethylaminobenzylidene; 2-benzylidene-aminocarbazole, polyvinylcarbazole; (2-nitrobenzylidene)p-bromoaniline; 2,4-diphenyl-quinazoline; 1,2,4-triazine; 1,5-diphenyl-3-methyl pyrazoline 2-(4'-dimethyl-amino phenyl)-benzoxazole; 3-amino-carbazole; polyvinylcarbazole-trinitrofluorenone charge transfer complex; phthalocyanines and mixtures thereof.

Additionally, the toner and developer compositions of the present invention can be selected for the development of electrostatic latent images formed on layered photoresponsive devices, comprised of a photogenerating layer, and a charge transport layer as described in U.S. Pat. No. 4,265,990, the disclosure of which is totally incorporated herein by reference. Examples of photogenerating layers that may be utilized include trigonal selenium, metal phthalocyanines, metal free phthalocyanines, vanadyl phthalocyanine, and the like, while examples of transport layers include various diamines dispersed in resinous binders, such as those illustrated in U.S. Pat. No. b 4,265,990.

In another embodiment of the present invention, the toner and developer compositions described are selected for developing electrostatic latent images formed on a photoresponsive imaging device, followed by transferring the developed images to a suitable substrate, and permanently affixing the image thereto. More specifically, the method of imaging involves the formation of a negatively charged electrostatic latent image on a layered photoresponsive device comprised of a substrate, overcoated with a photogenerating layer, which in turn is overcoated with a charge carrier transporting layer, followed by developing the image with the developer composition of the present invention containing the amine acid salt charge enhancing additive, subsequently transferring the developed image to a suitable substrate such as paper, and permanently affixing the image thereto, by heat or other suitable means.

The following examples are being supplied to further define the species of the present invention, it being noted that these examples are intended to illustrate and not limit the scope of the present invention. Parts and percentages are by weight unless otherwise indicated.

EXAMPLE I

There was prepared octyl dimethylamine tosylate by reacting N,N-dimethyl octyl amine, and p-toluene sulfonic acid monohydrate in the presence of 2-propanol. The N,N-dimethyl octyl amine is commercially available from Ethyl Corporation as ADMAC8, while the p-toluene sulfonic acid monohydrate crystal, molecular weight 190.22, melting point 103°-106° C. is commercially available from J. T. Baker Corporation, as 7-WO31. The isopropanol was obtained from J. T. Baker, and is identified as 2-propanol 9084, molecular weight 60.10.

A two liter four neck round bottom flask was fitted with a stirrer, a water cooled Friedrich's condensor, a 250 milliliter dropping funnel, a thermometer, and a heating mantle connected to an $I^2R$ thermowatch temperature controller.

There was dissolved in a mixing beaker p-toluene sulfonic acid (190.22 grams; 1.0 mole) in 750 milliliters of 2-propanol, at room temperature with vigorous mixing. The resulting acid solution was then placed in the 2 liter round bottom flask. Any traces of the acid solution remaining in the mixing beaker were washed into the flask with an additional 100 milliliters of 2-propanol.

Subsequently, N,N-dimethyl octyl amine, 157.30 grams, 1.0 mole was placed into the 250 milliliter dropping funnel.

The acid solution in the flask was then heated to 60° C. with stirring whereupon the octylamine was added to the acid solution at an initial rate of about 100 drops/minute over about a 45 minute period. During the last 25 minutes of amine addition, crystals formed in the reaction mixture. The rate of amine addition was then greatly reduced to allow the crystals to dissolve with agitation. The reaction was maintained at 60° C. for two hours after the addition of the amine was completed. As the reactants cooled with mixing, a crystalline solid separated from the reaction mixture when the temperature reached about 39° C. Mixing was stopped, and the reaction was allowed to cool to room temperature. The reaction was then allowed to stand at room temperature (about 22° C.) overnight.

The crystalline reaction product was then filtered, and the resulting product was redissolved in 500 milliliters of 45° C. 2-propanol. The solution was cooled to room temperature, then allowed to stand at room temperature for four hours, followed by placing in a freezer (−20° C.) overnight. The crystalline product was then filtered cold, washed on the filter with 200 milliliters of cold (about −10° C.) 2-propanol and air dried overnight. The product was finally dried to constant weight at 40° C. in a vacuum oven. A 70 percent yield of octyl dimethyl amine product melting at 124°-127.5° C. was obtained.

Elemental analysis of this product revealed the following:

| | C | H | N | S | O |
|---|---|---|---|---|---|
| Theoretical | 61.97 | 9.48 | 4.25 | 9.73 | 14.57 |
| Actual | 62.07 | 9.26 | 4.25 | 9.93 | 14.24 |

The octyl dimethyl amine tosylate product obtained was believed to be of the following structure as determined by infra-red analysis:

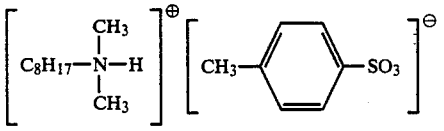

EXAMPLE II

There was prepared lauryl (dodecyl) dimethylamine tosylate by reacting N,N-dimethyllaurylamine, commercially available from Armak, as DM12D, p-toluene sulfonic acid monohydrate crystal, commercially available from J. T. Baker Corporation, as 7-WO31, and 2-propanol, available from J. T. Baker Corporation as 9084.

A two liter four neck round bottom flask was fitted with a stirrer, a water cooled Friedrich's condensor, a 250 milliliter dropping funnel, a thermometer, and a heating mantle connected to an $I^2R$ thermowatch temperature controller.

p-Toluene sulfonic acid (190.22 grams; 1.0 mole) was dissolved in 500 milliliters of 2-propanol, in a mixing beaker, at room temperature with mixing. The resulting acid solution was placed in the 2 liter round bottom flask. Any traces of acid solution remaining in the mixing beaker were washed into the flask with an additional 100 milliliters of 2-propanol.

Subsequently N,N-dimethyl dodecyl amine (213.30 grams; 1 mole) was placed in the 250 milliliter dropping funnel.

The acid solution was heated to 60° C. with stirring, whereupon the dodecyl amine was added to the acid solution over about a 45 minute period. After a few milliliters of amine was added, the reaction solution became orange in color. The color darkened as the reaction progressed, that is as more amine was added. During the last 25 minutes of amine addition, crystals formed in the reaction mixture. The rate of amine addition was then greatly reduced to allow the crystals to dissolve with agitation. The reaction was maintained at 60° C. for two hours after the addition of the amine was completed. The reaction was then cooled to room temperature with mixing until a white crystalline solid separated from solution at about 39° C. The reaction was allowed to stand overnight at room temperature (about 22° C.).

The resulting crystalline solid was then filtered from the reaction liquid and washed with 200 milliliters of cold (0° C.) 2-propanol. The crystalline solid was re-dissolved in 500 milliliters of 2-propanol at 50° C., and the solution was cooled to room temperature. A crystalline solid resulted which was filtered, washed with 200 milliliters of cold (0° C.) 2-propanol, and dried to constant weight. A yield of about 70 percent lauryl (dodecyl) dimethyl amine tosylate was obtained. This product had a melting range of 121° C.–125° C.

Elemental analysis of the amine tosylate product was as follows:

| | C | H | N | S | O |
|---|---|---|---|---|---|
| Theoretical | 65.41 | 10.19 | 3.63 | 8.31 | 12.45 |
| Actual | 65.36 | 10.28 | 3.56 | 8.36 | 12.54 |

The product lauryl (dodecyl) dimethyl amine tosylate is believed to be of the following structure as determined by infra-red analysis:

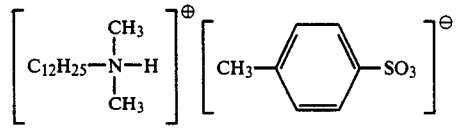

EXAMPLE III

There was prepared stearyl dimethyl amine tosylate by reacting N,N-dimethyloctadecylamine, commercially available from Armak, as DM18D, and p-toluene sulfonic acid, monohydrate crystal, commercially available from J. T. Baker Corporation, as 7-WO31, which reaction is accomplished in the presence of 2-propanol, (J. T. Baker Corporation 9084).

A two liter four neck round bottom flask was fitted with a stirrer, a water cooled Friedrich's condensor, a 250 milliliter dropping funnel, a thermometer and a heating mantle connected to an $I^2R$ thermowatch temperature controller. The p-toluene sulfonic acid (55.99 grams; 0.294 moles) was dissolved in 200 milliliters of 2-propanol at room temperature in a mixing beaker with stirring. When dissolution had occurred, the solution was added to the 250 milliliter dropping funnel.

N,N-dimethyl octadecyl amine was heated at 30° C. to assure that it was completely molten, followed by agitation to make sure it was homogeneous. Then, 87.48 grams (0.294 moles) of the molten amine was dissolved in 800 milliliters of 2-propanol, and the resulting solution was added to the reaction flask.

The amine/2-propanol solution in the reaction flask was heated to 60° C. with agitation (the reaction was carried out in air). While maintaining the agitated amine solution at 60° C., the p-toluene sulfonic acid/2-propanol solution was added dropwise to the amine/2-propanol solution over a period of 35 minutes. After addition of the amine to the acid, the reaction mixture was stirred for 30 minutes at 60° C. and then allowed to cool to room temperature with stirring. When room temperature was attained, the stirring was discontinued, and the reaction mixture was allowed to stand overnight.

The precipitate which formed on cooling and standing at room temperature was filtered through a #1 Whatman filter paper in a Buchner funnel (final traces of precipitate were washed from the reaction flask with about 100 milliliters of 2-propanol). While on the filter, the precipitate was washed with 100 milliliters of 2-propanol followed by a second washing with 200 milliliters of 2-propanol. The filtered stearyl dimethyl amine tosylate product was air dried for about 1 hour, and then vacuum dried for 24 hours to constant weight without heat. About 89 percent yield, 127.0 grams, of stearyl dimethyl amine tosylate product having a melting range of 119° C.–127° C. was obtained.

The stearyl dimethyl amine tosylate was recrystallized as follows. The stearyl dimethyl amine tosylate was dissolved with agitation at 60°-65° C. in a minimum amount of 2-propanol, (about 15 grams of stearyl dimethyl amine tosylate in 85 grams of 2-propanol); about a 15 weight percent solution. The stearyl dimethyl amine tosylate/2-propanol solution was cooled slowly to room temperature with agitation for about 5 hours and then was filtered with a number 1 Whatman filter paper. The filtered stearyl dimethyl amine tosylate was air dried overnight, followed by vacuum drying at 50° C. to constant weight, resulting in a white powder. A final stearyl dimethyl amine tosylate yield of 87.0 percent was realized.

The final amine tosylate product which had a melting range of 121°-124° C., with slight haziness becomes clear at 130° C., was believed to be of the following structure as determined by NMR and infra-red analysis:

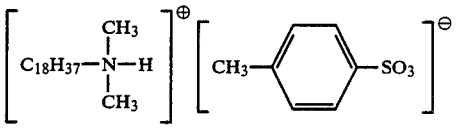

Elemental analysis of this product was as follows:

| | C | H | N | S | O |
|---|---|---|---|---|---|
| Theoretical | 69.18 | 10.75 | 2.99 | 6.84 | 10.24 |
| Actual | 69.22 | 10.47 | 2.96 | 7.02 | 10.27 |

EXAMPLE IV

There were prepared by melt blending and mechanical attrition, the toner compositions containing a styrene butadiene resin, (91 percent by weight of styrene and 9 percent by weight of butadiene), carbon black, and the charge enhancing additives as indicated in Table I. Developer compositions were prepared by blending the toners of Table I with a carrier, 100 microns in diameter, comprised of an oxidized Hoeganese core coated with 0.2 percent by weight of polyvinylidene fluoride, commercially available as Kynar.

TABLE 1

| Charge Enhancing Additive | Toner Composition No. | Weight % Styrene Butadiene Resin | Weight % Carbon black (Regal 330R) | Weight % Charge Enhancing Additive |
|---|---|---|---|---|
| octyl dimethyl amine tosylate | 1 | 93.43 | 6.00 | 0.57 |
| octyl dimethyl amine tosylate | 2 | 92.86 | 6.00 | 1.14 |
| octyl dimethyl amine tosylate | 3 | 91.71 | 6.00 | 2.29 |
| lauryl dimethyl amine tosylate | 4 | 93.33 | 6.00 | 0.67 |
| lauryl dimethyl amine tosylate | 5 | 92.66 | 6.00 | 1.34 |
| lauryl dimethyl amine tosylate | 6 | 91.32 | 6.00 | 2.68 |
| stearyl dimethyl amine tosylate | 7 | 93.00 | 6.00 | 1.00 |
| stearyl dimethyl amine tosylate | 8 | 92.00 | 6.00 | 2.00 |
| stearyl dimethyl amine tosylate | 9 | 91.00 | 6.00 | 3.00 |

TABLE 1-continued

| Charge Enhancing Additive | Toner Composition No. | Weight % Styrene Butadiene Resin | Weight % Carbon black (Regal 330R) | Weight % Charge Enhancing Additive |
|---|---|---|---|---|
| no additive | 10 | 94.0 | 6.00 | 0.00 |

The triboelectric charge generated by the above identified developer compositions were measured by the known Faraday cage technique as described, for example, in U.S. Pat. No. 3,526,533, with the results shown in Table II as toner tribo:

TABLE II

| Toner Composition | Toner Tribo* Microcoulombs per gram | | | |
|---|---|---|---|---|
| | 10 minutes | 1 hour | 3 hours | 5 hours |
| 1 | 57 | 51 | 41 | 36 |
| 2 | 59 | 52 | 40 | 34 |
| 3 | 58 | 45 | 30 | 26 |
| 4 | 55 | 50 | 42 | 39 |
| 5 | 61 | 51 | 44 | 40 |
| 6 | 65 | 50 | 41 | 31 |
| 7 | 59 | 49 | 34 | 25 |
| 8 | 67 | 58 | 41 | 33 |
| 9 | 68 | 60 | 41 | 32 |
| 10 | 19 | 8 | 5 | −11 |

*(2.3 percent toner concentration, 2.3 parts of toner per 100 parts of carrier).

Control toner composition 10 which did not contain any charge enhancing additive had a relatively unstable charge, and further the charge changed rapidly from a positive polarity to a negative polarity therefore rendering this toner composition substantially unusable in the imaging system of the present invention. Additionally, the toner tribo of composition 10 contained a relatively low positive charge after 1 hour, namely about 8 microcoulombs per gram, which is undesirable for use in an imaging system wherein the photoresponsive device is charged negatively.

EXAMPLE V

A developer composition prepared in accordance with Example IV and containing 1.0 weight percent of stearyl dimethyl amine tosylate, 93 percent by weight of styrene butadiene resin, (91 percent stryrene and 9 percent by weight of butadiene), 6 percent by weight of Regal 330 carbon black, and 100 parts by weight of a carrier containing a Hoeganese oxidized core coated with 0.2 percent of polyvinylidene fluoride, were selected for developing a negative latent image contained on a layered photoresponsive device comprised of a substrate, a trigonal selenium photogenerating layer, and a transport layer containing N,N-diphenyl-N,N'bis(3-methylphenyl)-1,1'-biphenyl-4,4'-diamine, dispersed in the inactive resinous binder, reference U.S. Pat. No. 4,265,990, which device contained a Viton fuser roll. Subsequent to transfer of the image to paper and permanently affixing the image thereto by heat, there resulted images of excellent quality, and excellent resolution.

Also, after 25,000 fusing cycles, no damage occurred to the Viton fuser roll, in that this roll had no surface cracking, and excellent high quality images resulted for 25,000 imaging cycles.

EXAMPLE VI

There was prepared by melt blending and mechanical attrition a toner composition containing 71 percent by weight of a styrene butadiene resin, (91 percent by weight of styrene and 9 percent by weight of butadiene), 2 percent by weight of Regal 330 carbon black, 25 percent by weight of the magnetite Mapico black, and 2 percent by weight of stearyl dimethyl amine tosylate. A developer composition was prepared by blending this toner, 2.8 parts by weight, with 100 parts by weight, of carrier particles containing an oxidized Hoeganese core coated with 0.2 percent by weight of polyvinylidene fluoride, commercially available as Kynar.

The triboelectric charge generated by the above prepared developer composition was measured by the known Faraday cage technique as described, for example, in U.S. Pat. No. 3,526,533, with a toner concentration of 2.8, (2.8 parts per toner per 100 parts of carrier) with the following results:

| Toner | Toner Tribo Microcoulombs per gram | | | | |
|---|---|---|---|---|---|
| Composition | 1 minute | 10 minutes | 1 hour | 3 hours | 5 hours |
| 1 | 33 | 45 | 42 | 33 | 30 |

The developer composition of this exaple was then selected for developing electrostatic latent images in a device in accordance with Example V and substantially similar results were obtained, after 25,000 imaging cycles.

Further, after 50,000 fusing cycles no damage (cracking, or hardening) occurred to the Viton fuser roll.

Other modifications of the present invention may occur to those skilled in the art based upon a reading of the present disclosure and these modifications are intended to be included within the scope of the present invention.

We claim:

1. A toner composition comprised of resin particles, and pigment particles, and from about 0.25 weight percent to about 20 weight percent of the charge enhancing additive stearyl dimethyl amine tosylate.

2. A toner composition comprised of resin particles, and pigment particles, and from about 0.25 weight percent to about 20 weight percent of the charge enhancing additive octyl dimethyl amine tosylate.

3. A toner composition comprised of resin particles, and pigment particles, and from about 0.25 weight percent to about 20 weight percent of the charge enhancing additive lauryl dimethyl amine tosylate.

4. A toner composition in accordance with claim 1 wherein the resin particles are comprised of a styrene butadiene copolymer.

5. A toner composition in accordance with claim 1 wherein the resin particles are polyesters, or a styrene methacrylate copolymer.

6. A toner composition in accordance with claim 5 wherein the styrene methacrylate copolymer is a styrene/n-butyl methacrylate copolymer.

7. A toner composition in accordance with claim 1 wherein the pigment particles are carbon black, magnetite, or mixtures thereof.

8. A toner composition in accordance with claim 7 wherein the carbon black particles are present in amount of from about 2 percent by weight to about 50 percent by weight.

9. A toner composition in accordance with claim 7 wherein the magnetite particles are present in amount of from about 10 percent by weight to about 70 percent by weight.

10. A developer composition comprised of resin particles, pigment particles, and carrier particles, and containing from about 0.25 weight percent to about 20 weight percent based on the weight of the toner particles of the charge enhancing additive stearyl dimethyl amine tosylate, octyl dimethyl amine tosylate, or lauryl dimethyl amine tosylate.

11. A developer composition in accordance with claim 10 wherein the resin particles are a styrene butadiene copolymer, a styrene n-butyl methacrylate copolymer, or polyesters.

12. A developer composition in accordance with claim 10 wherein the carrier particles contain a steel core coated with a polyvinylidene fluoride resin.

13. A method of imaging which comprises providing a negatively charged photoresponsive imaging member, followed by contacting this member with the developer composition of claim 10 and subsequently transferring the developed image to a suitable substrate, and optionally permanently affixing the image thereto, and wherein the charge enhancing additive is stearyl dimethyl amine tosylate, octyl dimethyl amine tosylate, or lauryl dimethyl amine tosylate.

14. A method of imaging in accordance with claim 1 wherein the resin particles are a styrene butadiene copolymer, polyesters, or a styrene n-butyl copolymer.

15. A developer composition in accordance with claim 10 wherein the carrier particles contain a coating selected from the group consisting of polystyrene, homopolymers, copolymers, or terpolymers of halogen containing ethylenes selected from the group consisting of vinyl fluorides, vinylidene fluorides, vinyl chlorides, vinylidene chlorides, and chlorotrifluoroethylene.

16. A developer composition in accordance with claim 15 wherein the carrier coating is a vinyl chloride/chlorotrifluoroethylene copolymer, a vinyl chloride/vinyl acetate copolymer, or a chlorotrifluoroethylene polymer, and the carrier core is steel.

17. A toner composition in accordance with claim 1 wherein the charge enhancing additive is present in an amount of from about 0.5 percent by weight to about 4.0 percent by weight.

18. A developer composition in accordance with claim 10 wherein the charge enhancing additive is present in an amount of from about 0.5 percent by weight to about 4.0 percent by weight.

19. A developer composition in accordance with claim 10 wherein the carrier particles contain a core coated with a fluoropolymer resin.

20. A developer composition in accordance with claim 10 wherein the pigment particles are carbon black, magnetite, or mixtures thereof.

21. A developer composition in accordance with claim 10 wherein the carbon black particles are present in an amount of from about 2 percent by weight to about 50 percent by weight.

22. A developer composition in accordance with claim 10 wherein the magnetite particles are present in an amount of from about 10 percent by weight to about 70 percent by weight.

23. A method of imaging in accordance with claim 13 wherein the image is permanently affixed to a substrate utilizing a fusing mechanism comprised of a soft roll fuser.

24. A method of imaging in accordance with claim 23 wherein the soft roll fuser is comprised of lead oxide coated with a vinylidene fluoride hexafluoropropylene copolymer resin.

* * * * *